US008265500B2

(12) United States Patent
Kitajima

(10) Patent No.: US 8,265,500 B2
(45) Date of Patent: Sep. 11, 2012

(54) IMAGE FORMING APPARATUS

(75) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 12/555,215

(22) Filed: Sep. 8, 2009

(65) Prior Publication Data

US 2010/0067936 A1 Mar. 18, 2010

(30) Foreign Application Priority Data

Sep. 17, 2008 (JP) ..... 2008-238433

(51) Int. Cl.
*G03G 15/00* (2006.01)

(52) U.S. Cl. ..... 399/49; 399/45; 399/55; 399/72

(58) Field of Classification Search ..... 399/49, 399/55, 285
See application file for complete search history.

(56) References Cited

U.S. PATENT DOCUMENTS

| | | | | |
|---|---|---|---|---|
| 2004/0114948 | A1* | 6/2004 | Iida et al. | 399/44 |
| 2007/0110463 | A1* | 5/2007 | Sako et al. | 399/45 |
| 2007/0134012 | A1 | 6/2007 | Suzuki et al. | 399/49 |

FOREIGN PATENT DOCUMENTS

| | | |
|---|---|---|
| JP | 2001-027838 | 1/2001 |
| JP | 2001-356536 | 12/2001 |
| JP | 2007-121906 | 5/2007 |
| JP | 2007-178928 | 7/2007 |

* cited by examiner

*Primary Examiner* — Walter L Lindsay, Jr.

*Assistant Examiner* — Benjamin Schmitt

(74) *Attorney, Agent, or Firm* — Fitzpatrick, Cella, Harper & Scinto

(57) ABSTRACT

An image forming apparatus which includes a photosensitive member and an image forming station. The image forming station includes a charging device for charging the member, an exposure device for exposing the member to light, a developing device for developing an electrostatic latent image on the member, and a bias applying device for applying a developing bias. The image forming apparatus also includes, a transfer device for transferring a toner image to a sheet, a setting device for setting an AC voltage, an executing device for executing a test mode, a density detecting device for detecting the density of the test image, and an adjusting device for adjusting an image forming condition for the station. When the executing device executes the test mode, test images can formed at various AC voltages.

16 Claims, 13 Drawing Sheets

〈IMAGE FORMING CONDITION〉

| TYPE | AC | DC | EXPOSURE |
|---|---|---|---|
| PLAIN PAPER | Vpp1 | Vdc1 | LPW1 |
| COATED PAPER | Vpp2 | Vdc2 | LPW2 |

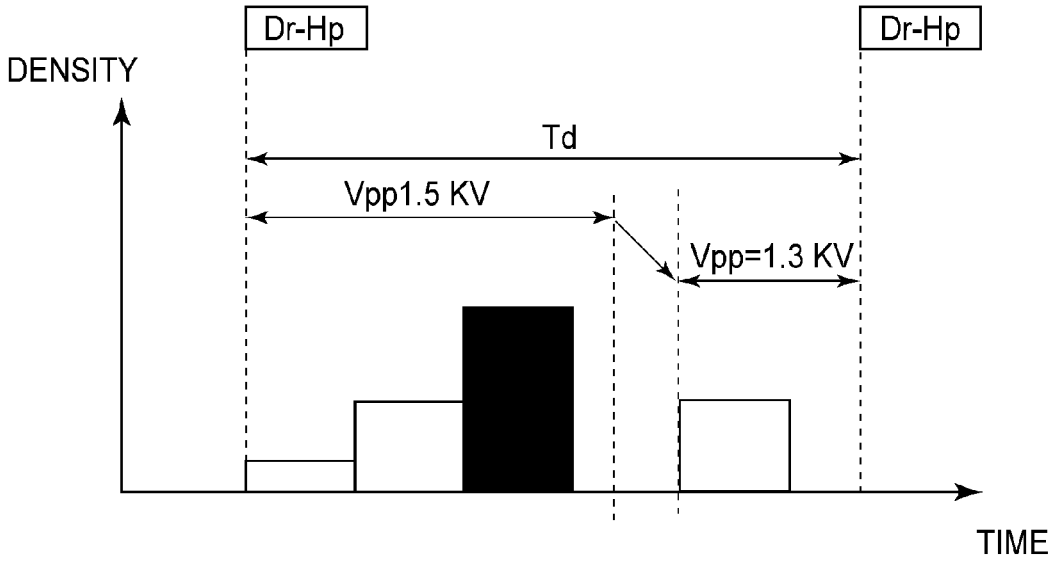
FIG.18
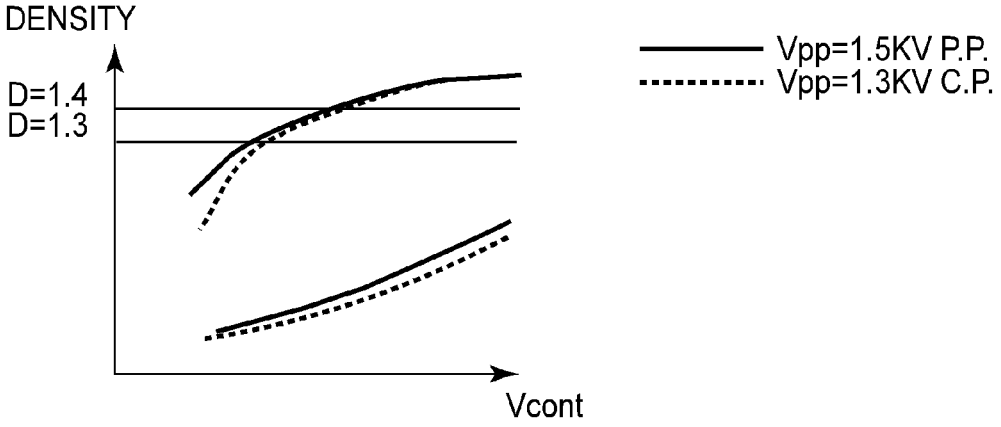
FIG.19
| TYPE | CONTRAST | S.D. | I.D. | D.D. |
|---|---|---|---|---|
| PLAIN PAPER | 170V | 1.4 | 0.3 | 0.1 |
| COATED PAPER | 150V | 1.3 | 0.2 | |
FIG.20

IMAGE FORMING APPARATUS

FIELD OF THE INVENTION AND RELATED ART

The present invention relates to an image forming apparatus using electrophotography and particularly relates to an image forming apparatus such as a copying machine, a printer, or a facsimile machine.

In the electrophotographic image forming apparatus, in order to reproduce a density depending on an image signal as intended, a photosensitive member as an image bearing member is electrically charged uniformly by a charging means. Further, an electrostatic latent image is formed on the photosensitive member by an exposure means and is developed into a toner image by a developing means. The toner image is transferred onto recording paper by a transfer means.

In order to effect stable image formation, it is important that the toner image formed with a latent image potential by the developing means is always stable. Further, a transfer property and a fixing property in the image formation vary depending on a material, a surface property, a thickness, or the like of the recording paper.

That is, in order to stabilize an image quality, it is important that an image forming condition for the toner image to be subjected to development on the image bearing member is controlled every type of the recording paper. Therefore, it is necessary to adjust the image forming condition for each recording paper. For this purpose, a technique for switching a process speed and a developing high voltage depending on the thickness of the recording paper (Japanese Laid-Open Patent Application (JP-A) 2007-121906), a technique for reducing an amount of toner to be subjected to the development by adjusting high voltages for the charging means and the developing means depending on the type of recording paper (JP-A 2001-356536), and the like have been proposed.

Further, as a technique for stabilizing an image quality by suppressing a density fluctuation during a continuous operation, such a technique that a toner image is formed with pre-set timing and with a predetermined pattern and then a density of the toner image on a photosensitive member or an intermediary transfer member is detected and then a resultant detection result is fed back, thereby to adjust the image forming condition, the high voltage for the charging means, light amount for the exposure means, the high voltage for the developing means, and the transfer means has been proposed (JP-A 2007-178928).

In such techniques, the density fluctuation for plain paper is measured at a predetermined interval in a first mode and only in the case where the density fluctuation not less than a predetermined value, a developing condition for a second mode in which low speed image formation set for thick paper is effected is adjusted.

Incidentally, background contamination (fog) at a non-image portion (white paper portion), disturbance (scattering) at a character portion or a ruler line portion of the toner image, and a difference in fixability at the time of fixing the toner image on the recording paper become factors in causing necessity to change the image forming condition of the toner image depending on the type (material) of the recording paper.

A test pattern is formed when the developing device is exchanged, and on the basis of the test pattern, the developing condition for the developing device is corrected (JP-A 2001-27838).

In recent years, many image forming apparatuses have the function of preparing printed matters such as a bound print and a saddle-stitched print or are connectable with an apparatus having such a function. In such apparatuses, a print volume is large and a status of use is close to a continuous running state substantially throughout the day in many cases.

In the case of preparing the printed matters such as the bound print and a booklet, an original for print prepared by a PC (personal computer) or the like is printed by the image forming apparatus. During the printing, a user effect condition setting of the type of paper such as plain paper or coated paper, and the like for each of a front cover, a chapter cover, an intermediate cover, and the like correspondingly to each original page on an operating panel for a developer driver on the PC, so that a print job (instruction) information is transmitted to the image forming apparatus.

The image forming apparatus effects image formation by continuously switching an image forming apparatus depending on recording paper information while appropriately switching the type of recording paper every page. Such an image forming mode is referred to as a mixed (image forming) mode.

In the mixed mode, it is desirable that an AC voltage to be applied to the developing device is changed between when the image is formed on the plain paper and when the image is formed on the coated paper (thick paper).

In this way, in the mixed mode, continuous (successive) image formation is effected with respect to different types of recording paper but a density of an image output in the mixed mode is required to be stabilized.

SUMMARY OF THE INVENTION

A principal object of the present invention is to provide an image forming apparatus capable of suppressing a fluctuation in image density when an image is successively formed on a plurality of sheets including a first sheet and a second sheet which are mutually different in the type (material).

Another object of the present invention is to provide an image forming apparatus capable of improving stability in density and image quality without causing downtime in a continuous job.

According to an aspect of the present invention, there is provided an image forming apparatus comprising:

a photosensitive member;

an image forming station including a charging device for electrically charging the photosensitive member, an exposure device for exposing to light the photosensitive member charged by the charging device, a developing device for developing with toner an electrostatic latent image formed on the photosensitive member by the exposure device, and a bias applying device for applying to the developing device a developing bias comprising a DC voltage and an AC voltage;

a transfer device for transferring a toner image from the photosensitive member onto a sheet;

a setting device for setting the AC voltage at a first AC voltage when image formation is effected on a first sheet and setting the AC voltage at a second AC voltage different from the first AC voltage when image formation is effected on a second sheet different in type from the first sheet;

an executing device for executing a test mode for forming a test image on the photosensitive member;

a density detecting device for detecting a density of the test image in the test mode; and an adjusting device for adjusting an image forming condition for the image forming station depending on an output of the density detecting device;

wherein when the executing device executes the test mode during a job for effecting image formation successively on a plurality of sheets including the first sheet and the second sheet, a first test image is formed with the AC voltage set at the first AC voltage and then a second test image is formed with the AC voltage set at the second AC voltage.

According to another aspect of the present invention, there is provided an image forming apparatus comprising:

a photosensitive member;

an image forming station including a charging device for electrically charging the photosensitive member, an exposure device for exposing to light the photosensitive member charged by the charging device, a developing device for developing with toner an electrostatic latent image formed on the photosensitive member by the exposure device, and a bias applying device for applying to the developing device a developing bias comprising a DC voltage and an AC voltage;

a transfer device for transferring a toner image from the photosensitive member onto a sheet;

a setting device for setting the AC voltage at a first AC voltage when image formation is effected on a first sheet and setting the AC voltage at a second AC voltage different from the first AC voltage when image formation is effected on a second sheet different in type from the first sheet;

an executing device for executing a test mode for forming a test image on the photosensitive member;

a density detecting device for detecting a density of the test image in the test mode; and an adjusting device for adjusting an image forming condition for the image forming station depending on an output of the density detecting device;

wherein when the executing device executes the test mode during a job for effecting image formation successively on a plurality of sheets including the first sheet and the second sheet, a first test image is formed with the AC voltage set at a third AC voltage correlated with the first AC voltage and then a second test image is formed with the AC voltage set at the second AC voltage.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 18 is a schematic view showing a model of a test pattern.

FIG. 19 is a graph showing a relationship between an intermediate density and the developing contrast.

FIG. 20 is a schematic view showing a developing condition and density information for two types of recording paper.

DESCRIPTION OF THE PREFERRED EMBODIMENTS

Figure 1:
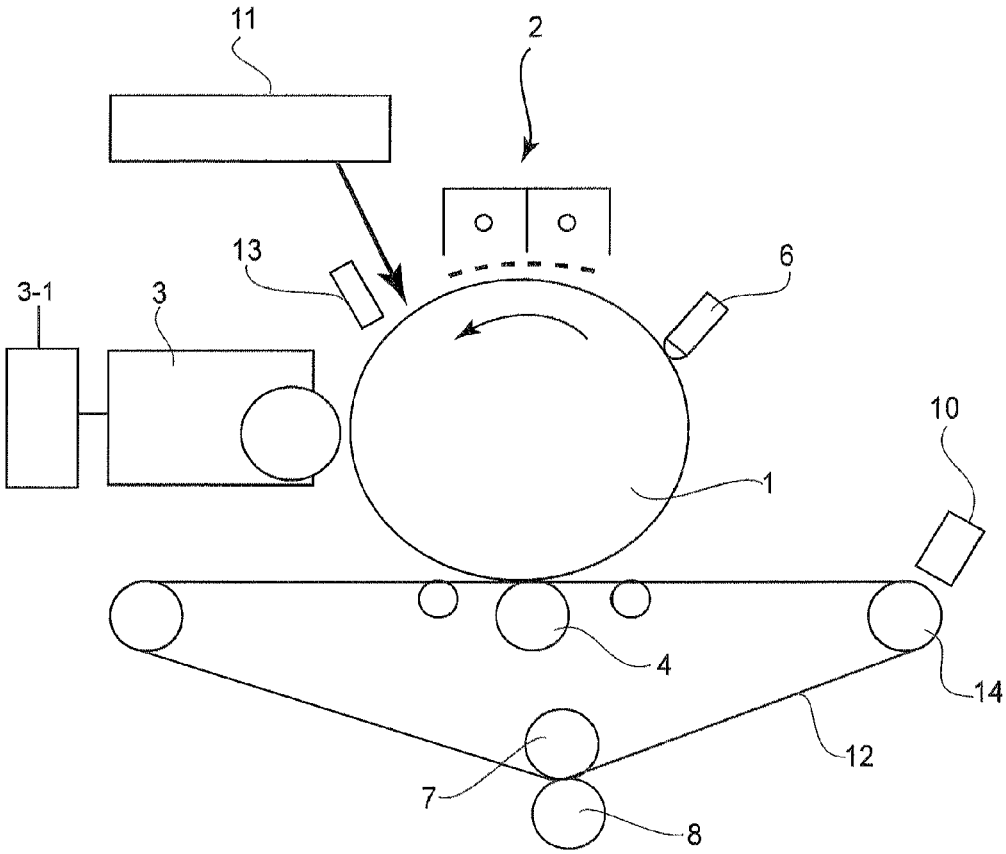
FIG. 1 is a structural view of an image forming apparatus according to an embodiment of the present invention.

Hereinbelow, embodiments of the present invention will be described with reference to the drawings. FIG. 1 is a structural view showing an electrophotographic image forming apparatus as an embodiment of the present invention.

Embodiment 1

The image forming apparatus shown in FIG. 1 includes a drum-like electrophotographic photosensitive member 1 as an image bearing member (hereinafter referred to as a photosensitive drum). Around the photosensitive drum 1, a developing device 3, a light discharging means 6, a charging device 2, and an image exposure means 11 are disposed. Further, as transfer means, an intermediary transfer belt 12, a primary transfer roller 4, a secondary transfer roller 8, and a back-up roller 7 are disposed. The image forming apparatus further includes a surface potential sensor 13 for measuring a surface potential of the photosensitive drum 1 and a toner density sensor (density detecting means) 10 for detecting a density of a toner image formed on the intermediary transfer belt 12.

The photosensitive drum 1 is an amorphous silicon (a-Si) drum using an amorphous silicon photosensitive member and a lifetime thereof is prolonged by employing the amorphous silicon drum excellent in anti-wearing property. However, the type of the photosensitive drum 1 is not limited to the amorphous silicon drum but may also be a generally used OPC (organic photoconductor) photosensitive member.

Figure 2:
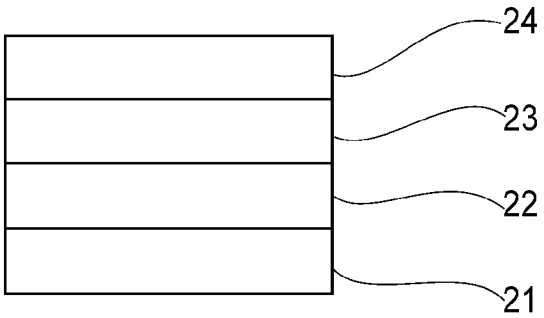
FIG. 2 is a layer structural view of a photosensitive drum of the image forming apparatus shown in FIG. 1.

The photosensitive drum 1 has a layer structure, as shown in FIG. 2, including an electroconductive Al substrate 21 and a photosensitive layer 23 which is disposed above the Al substrate 21 and is principally formed of amorphous silicon. Between the Al substrate 21 and the photosensitive layer 23, an electron injection inhibition layer 22 of an amorphous silicon type is disposed, and on the photosensitive layer 23, a surface layer 24 of the amorphous silicon type is disposed.

The charging means 2 electrically charges the photosensitive drum 1 to a predetermined potential and uses a corona charging device of a scorotron type. The light discharging means 6 is disposed upstream of the charging means 2 with respect to a rotational direction of the photosensitive drum 1 and functions as a pre-exposure means, i.e., a light discharging exposure device such as an LED (light-emitting diode)

array. In this embodiment, a wavelength is 660 nm and an exposure amount for the light discharging is 4.0 μJ/cm$^2$.

The image exposure means 11 is a laser exposure device for writing (forming) an electrostatic latent image on the charged photosensitive drum 1 depending on image information and employs a BAZ (background area exposure) latent image forming system. That is, a non-image portion (sheet interval portion) between image portions and a non-image forming portion in an image portion are exposed to light.

The develop device 3 is supplied with a superposed developing bias comprising a DC voltage and an AC voltage by a bias applying device 3-1 and is a jumping development system using one component magnetic toner as a developer. The intermediary transfer belt 12 is provided under the photosensitive drum 1 and holds toner images formed on the photosensitive drum 1 and successively transferred (primary-transferred) from the photosensitive drum 1 onto the intermediary transfer belt 12.

The secondary transfer roller 8 is disposed to press-contact the intermediary transfer belt 12 on a toner image carrying surface side of the intermediary transfer belt 12. The back-up roller 7 is disposed on a back surface side of the intermediary transfer belt 12 so that it constitute an opposite electrode to the secondary transfer roller 8.

The intermediary transfer belt 12 is extended around the back-up roller 7 and other rollers such as a supporting roller 14 connected to a driving source (not shown) and is driven by the supporting roller 14. The back-up roller 7 is provided with a contact and separation mechanism (not shown) and is retractable into a position in which it does not contact the intermediary transfer belt 12 in a period other than a transfer operation with respect to the recording paper.

Further, when a density of a test pattern is measured in a test mode by using the toner density sensor 10, in order to prevent toner deposition onto the secondary transfer roller 8, the secondary transfer roller 8 is placed in a separation state to suppress backside contamination caused by unnecessary toner deposition onto the secondary transfer roller 8.

That is, when a test pattern image on the intermediary transfer belt 12 passes through a secondary transfer position, a separation operation for the secondary transfer roller 8 is performed to control the secondary transfer roller 8 so as not to be contaminated with the toner, so that the backside contamination with respect to the recording paper (sheet) is prevented from occurring when the printing operation is resumed. The intermediary transfer belt 12 is provided with a belt cleaner (not shown) for removing a residual matter remaining on the intermediary transfer belt 12 after the secondary transfer. The intermediary transfer belt 12 is formed by incorporating an appropriate amount of an electroconductive agent such as carbon black or the like into a resin material such as polyimide, polyester, polypropyrene, or polyethylene terephthalate or into various rubbers. The intermediary transfer belt 12 has a volume resistivity of 105 to $10^{15}$Ω×cm and thickness of 0.1 mm.

As the back-up roller 7, an EPDM (ethylene propyrene diene (monomer) terpolymer) rubber roller having a two-layer structure consisting of an inner foamed elastic layer formed on an outer periphery of a metal core material and an outer electroconductive layer formed by coating the elastic layer. The other electroconductive layer is formed of a semiconductor EPDM foamed rubber containing 15 to 35 wt. % of carbon black dispersed therein. The electroconductive layer has a thickness of 0.5 to 1.5 mm and is controlled to have a surface resistivity of 7 to 10 Ω/□.

The secondary transfer roller 8 is prepared by forming a 5 to 20 μm-thick coating layer of a fluorine-containing resin material, through a skin layer, on a core layer consisting of a metal core material and a carbon black-dispersed foamed EPDM material fixed around the metal core material. A volume resistivity between the metal core material and the coating layer is $10^4$ to $10^5$Ω×cm. The recording paper after the secondary transfer is conveyed to a fixing device (not shown) and then is discharged from the fixing device to the outside of the image forming apparatus.

The surface potential sensor 13 is disposed oppositely to the photosensitive drum 1 and is a surface potential detecting means for detecting a surface potential of the photosensitive drum 1. The toner density sensor 10 is disposed opposite to the supporting roller 14 for the intermediary transfer belt 12 and not only detects the density of the test image formed on the intermediary transfer belt 12 but also functions as an image carrying member for carrying the test image during density adjustment. The test image is called a test patch, a patch pattern, a pattern image, a patch image, or the like.

The test image is formed on the intermediary transfer belt 12 and is read by the toner density sensor 10. On the basis of the obtained density data, a parameter such as a developing high voltage condition or an image exposure light amount corresponding to the density is adjusted with respect to a target density value set depending on Vpp (peak-to-peak voltage) of a developing high voltage varying depending on each recording paper, thus being adjusted into a proper image forming condition every recording paper.

The image forming apparatus employs a plurality of image forming conditions different every type of recording paper, such as plain paper, coated paper, or the like. For example, in the case of the coated paper, compared with the plain paper, when a fog image occurs or a toner amount at the time of transferring the test image onto the recording paper is excessively large, line scattering at a character portion or a ruler line portion is liable to occur. For this reason, the image forming condition for the coated paper is set, so that the occurrence of the scattering is suppressed. Further, the secondary transfer roller 8 is provided with a control means for variably controlling a transfer voltage depending on the type and thickness of the recording paper and for appropriately switching setting of a transfer voltage depending on the type of the recording paper.

Figure 3:
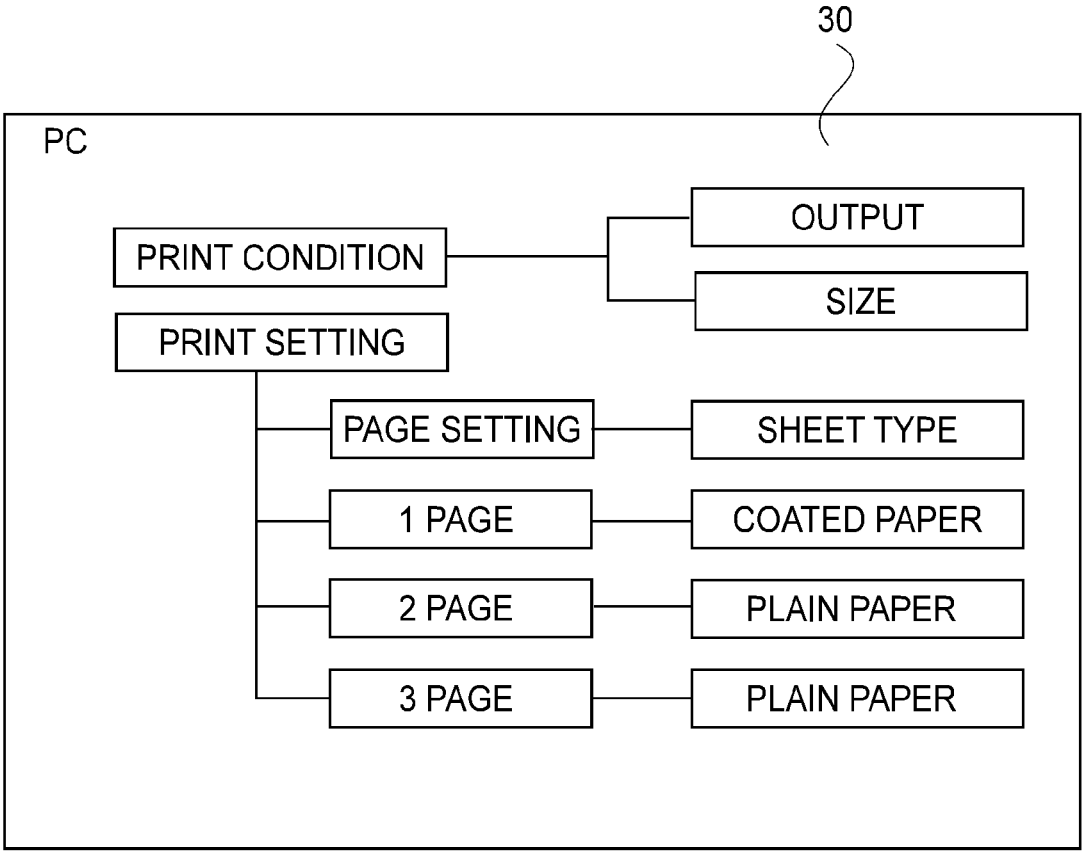
FIG. 3 is an explanatory view of print information sent from a PC to the image forming apparatus.

Next, an image forming process of the image forming apparatus will be described. First, when a start switch is turned on by the PC or the like connected to the image forming apparatus, a predetermined image forming process is executed. In the case where the image forming apparatus is constituted as a printer, as shown in FIG. 3, various settings including print condition setting for a size of an original, the number of output sheets, and a size of recording paper and print setting for the type of recording paper depending on each of pages for printing and the like are made by a PC 30, and print information thereon is sent to the image forming apparatus.

Figure 4:
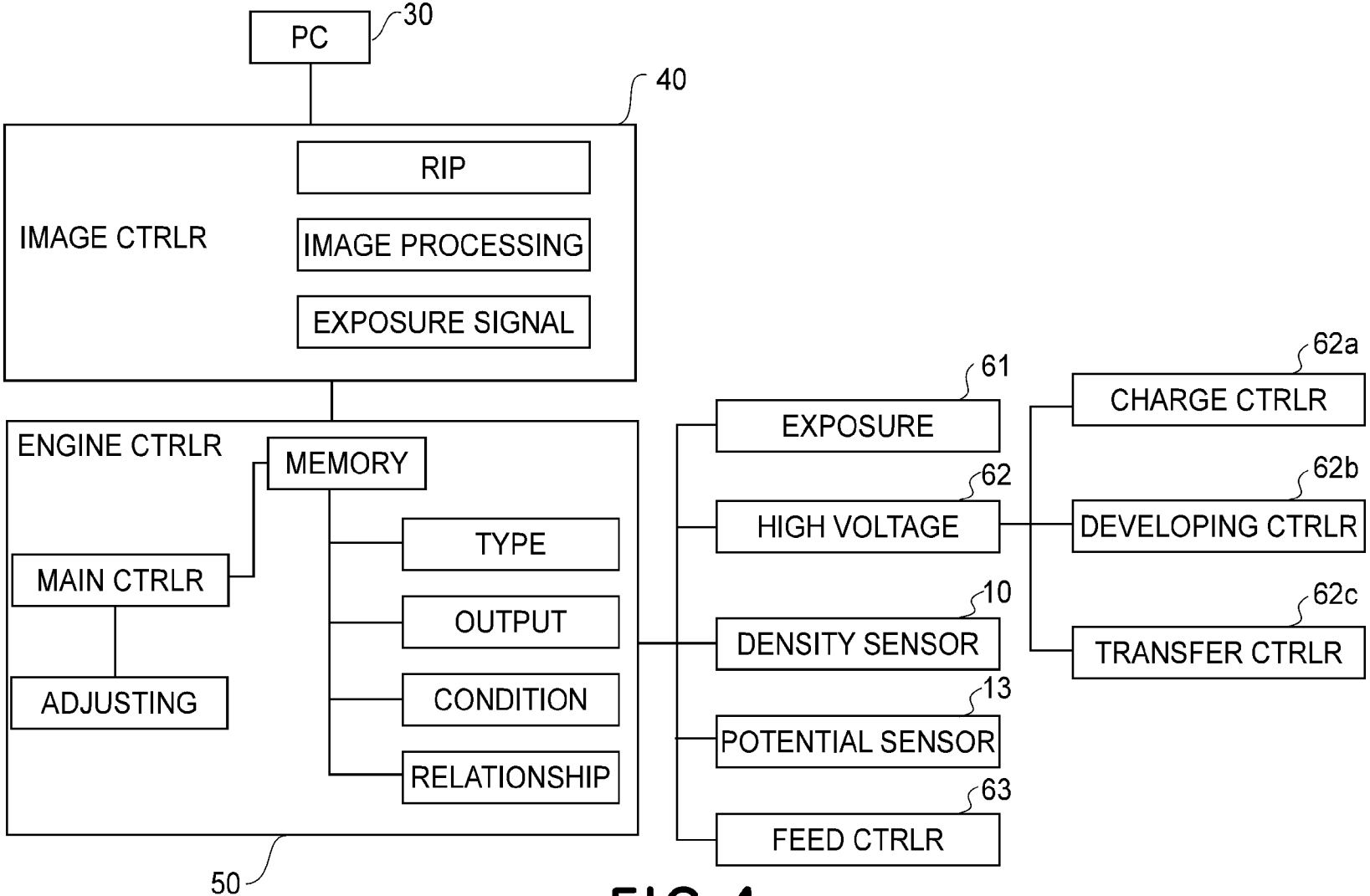
FIG. 4 is a schematic view for illustrating a relationship among the PC, an image formation controllers, and an engine controller.
Figure 5:
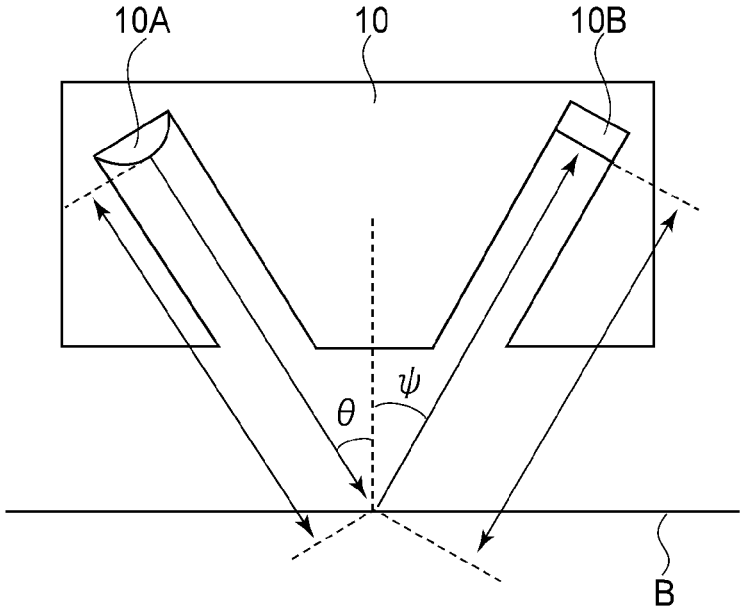
FIG. 5 is a structural view of a toner density sensor.

The print information received from the PC 30 is processed by an image forming controller 40 shown in FIG. 4. An engine controller 50 controls high voltages to be applied to the image exposure means 11, the charging device 2, and the developing device 3 and supply of the recording paper depending on the original, on the basis of data from the image forming controller 40. The image forming controller 40 and the engine controller 50 are constituted by a CPU (central processing unit), a RAM (random-access memory), a ROM (read-only memory), an ASIC (application-specific integrated circuit), and the like which are not shown.

In the image forming controller 40, a raster image processor (RIP) expands the image data received from the PC 30 into a bit map image. The image forming controller 40 converts the bit map image into image exposure data, depending on image signal data, for light irradiation depending an image signal by the image exposure means 11. Thereafter, the image exposure data is sent to a control portion of the image exposure means 11 via the engine controller 50, so that an amount of exposure light output from the image exposure means 11 is controlled. Then, the image exposure means 11 forms an electrostatic latent image on the surface of the photosensitive drum 1.

A main control portion of the engine controller 50 effects centralized control of respective units connected to the engine controller 50 functioning as a setting device and an executing device. Examples of the units connected to the engine controller 50 may include an exposure control portion 61, a high voltage control portion 62, the toner density sensor 10, the surface potential sensor 13, and a sheet feeding and conveying control portion 63.

The high voltage control portion 62 includes a charging high voltage control portion 62*a*, a developing high voltage control portion 62*b*, and a transfer high voltage control portion 62*c*. The sheet feeding and conveying control portion 63 effects control of feeding and conveying of a plurality of sheets of the recording paper accommodated in a cassette.

An adjusting portion of the engine controller 50 adjusts an image forming parameter corresponding to a density of an image to be formed depending on the type of the recording paper. For example, the adjusting portion adjusts an AC voltage or the like of a developing high voltage depending on the type of the recording paper such as plain paper or coated paper. That is, a proper toner amount is controlled depending on the type of the recording paper by appropriately adjusting the developing high voltage for the developing device 3 and the light amount of the image exposure means 11 as desired, so that a proper toner amount is controlled depending on the type of the recording paper so as not to cause occurrences of fog and scattering of the image of a character or the like produced by the difference in type of the recording paper.

A storing portion of the engine controller 50 is an RPM (remote print manager) or the RAM for storing a control program and various data and stores the type of the recording paper output during the image formation, the number of output sheets, and the density of the test image depending on the image forming condition of each recording paper.

To the toner density sensor 10, a light-emitting element 10A such as an LED (light-emitting diode) and a light-receiving element 10B such as a photodiode are mounted. Irradiation light from the light-emitting element 10A is incident on an object to be measured B at an angle of θ and is reflected by the object to be measured B. The light-receiving element 10B opposes the object to be measured B at an angle ϕ and detects both of specular reflected light and diffuse reflected light from the object to be measured B. In this embodiment, θ and ϕ are equal to each other and are 30 degrees. A light beam emitted from the light-emitting element is reflected by the intermediary transfer belt 12 as a background and is detected by the light-receiving element 10B. When the test image is formed on the intermediary transfer belt 12, the background portion on which the toner image is placed is hidden to reduce the reflected light amount.

Figure 6:
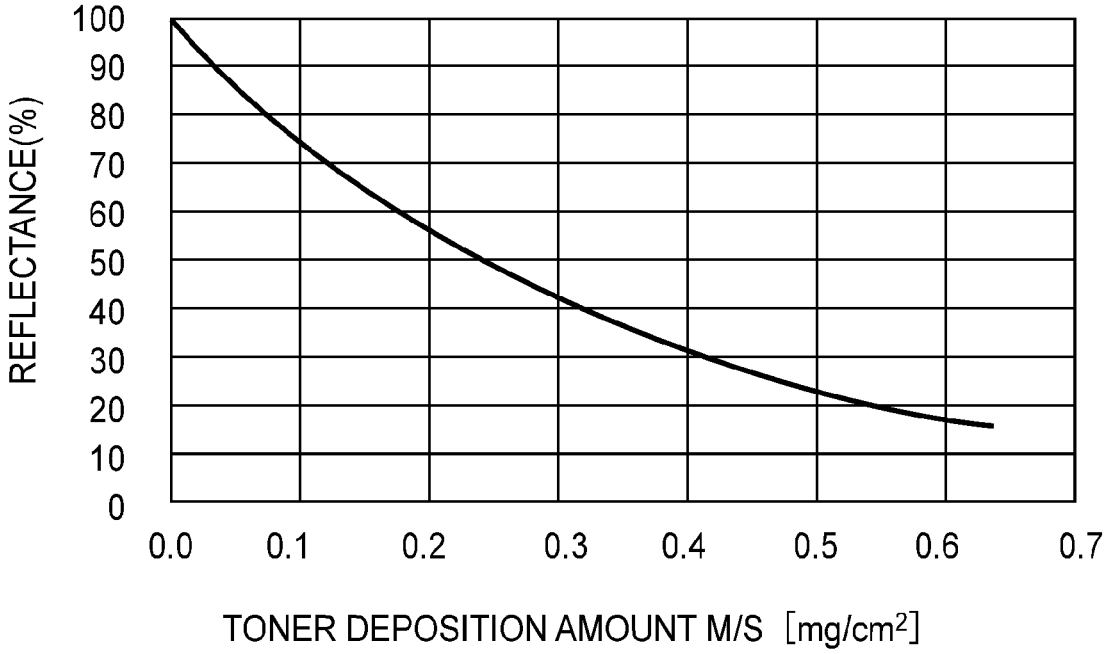
FIG. 6 is a graph showing a relationship between a reflected light amount (reflectance) of the toner density sensor and a toner deposition amount.

Therefore, with an increasing toner deposition amount of the toner image, the reflected light amount is gradually decreased as shown in FIG. 6. On the basis of such a relationship between the toner deposition amount and the reflected light amount, the density of the test image can be obtained.

Figure 7:
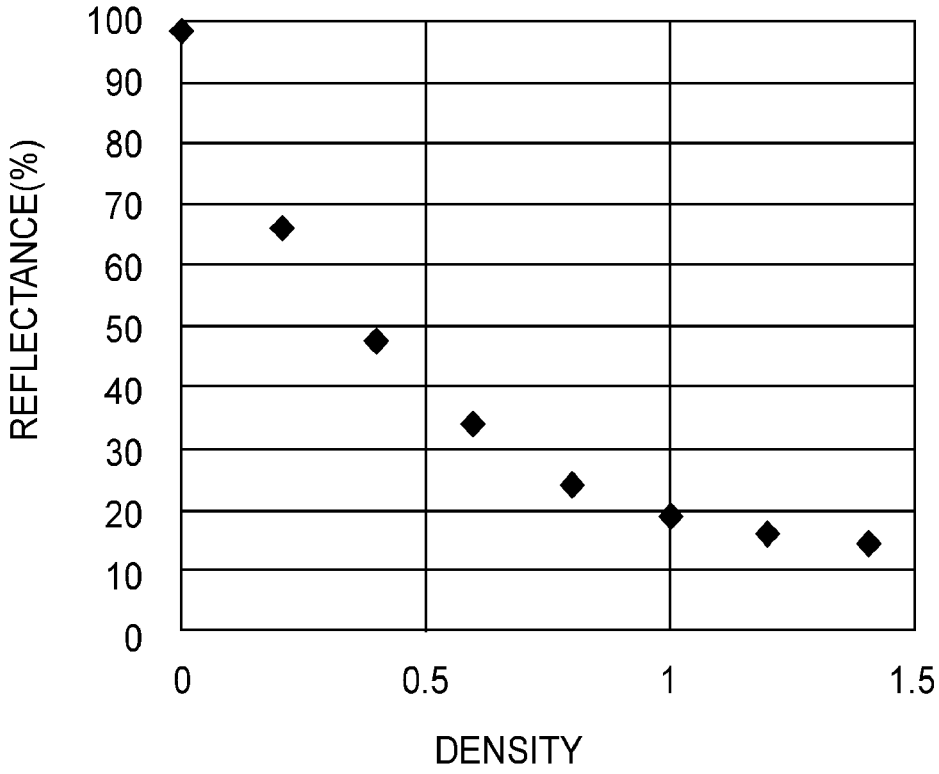
FIG. 7 is a graph showing a relationship between the reflected light amount of the toner density sensor and a reflection density on recording paper.

A relationship between the toner deposition amount on the intermediary transfer belt 12 and the toner density obtained after the transfer and the fixation is substantially constant every type of the recording paper. By storing the relationship between the toner deposition amount and the toner density on the recording paper in the storing portion of the engine controller 50 as shown in FIG. 7, it is possible to detect a change in density for each recording paper from the toner deposition amount measured by using the test image.

Further, in the image forming apparatus of this embodiment an AC voltage component of the developing high voltage is switched between those for the plain paper and the coated paper. Further, a developing contrast potential (a potential difference between a charge potential VD and a develop DC voltage) and a non-image portion potential (a potential difference between the DC voltage and an exposed portion potential VL) are switched.

Figure 8:
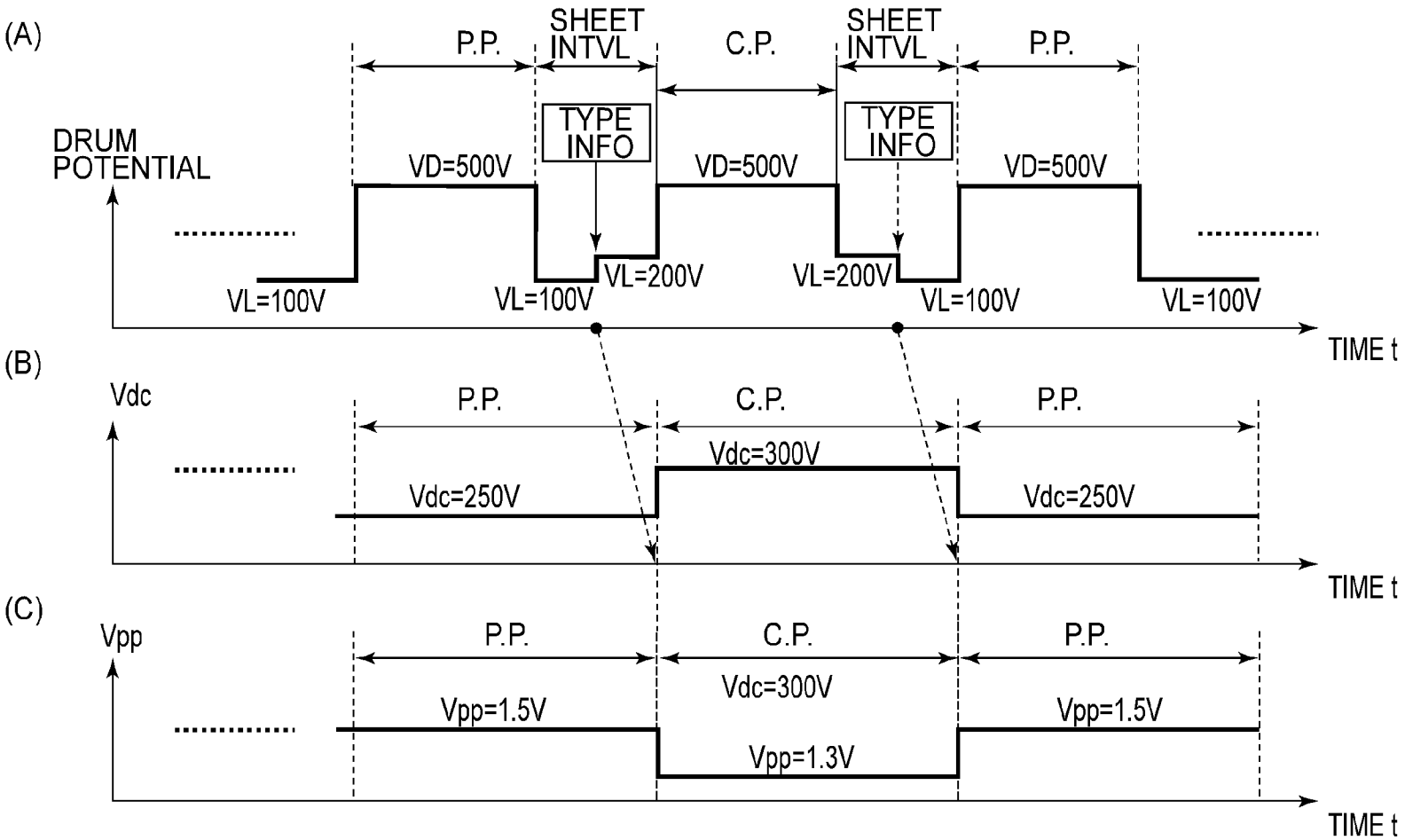
FIGS. 8(A) to 8(C) are time charts for illustrating a sequence of a switching operation of an image forming condition.

As an example of a image forming condition switching operation, a sequence model is shown in FIGS. 8(A) to 8(C). FIGS. 8(A) to 8(C) each show a state in which the image forming condition is continuously switched every page in the order of the plain paper, the coated paper, and the plain paper in the mixed mode. The mixed mode refers to a mode in which image formation is effected while switching the type of the recording paper during a series of printing operations (image forming jobs).

In the image forming apparatus of this embodiment, depending on the type of the recording paper, the image forming conditions, specifically three types of values of the light amount of the image exposure device, the developing high voltage DC voltage, and Vpp (peak-to-peak) are changed.

The switching of the image forming conditions is, as shown in FIG. 8(A), performed by switching the exposure amount of the image exposure device 11 on the basis of paper type information for each print page. Then, with timing such that a potential position of the photosensitive drum 1 switched in a sheet interval reaches the developing position, as shown in FIGS. 8(B) and 8(C), the developing DC voltage and the Vpp of the AC voltage are switched.

In this embodiment, due to a difference in transferability when the toner image is transferred onto the recording paper, fog toner present in a non-image portion area on the intermediary transfer belt 12 is liable to be transferred. Further, in order to prevent toner image scattering during the transfer, the image forming condition is switched between those for the plain paper and the coated paper. In this embodiment, in the case of thick paper having a larger thickness than the plain paper, the same image forming condition as that for the coated paper is employed.

Incidentally, the control of the toner amount and the toner density by switching the image forming condition for each recording paper is not limited to the cases of the plain paper and the coated paper but may also be applicable to other cases including a plurality of image forming conditions for various types of the recording paper including a special-purpose recording material and the like such as an OHP (overhead projector) sheet.

Figure 9:
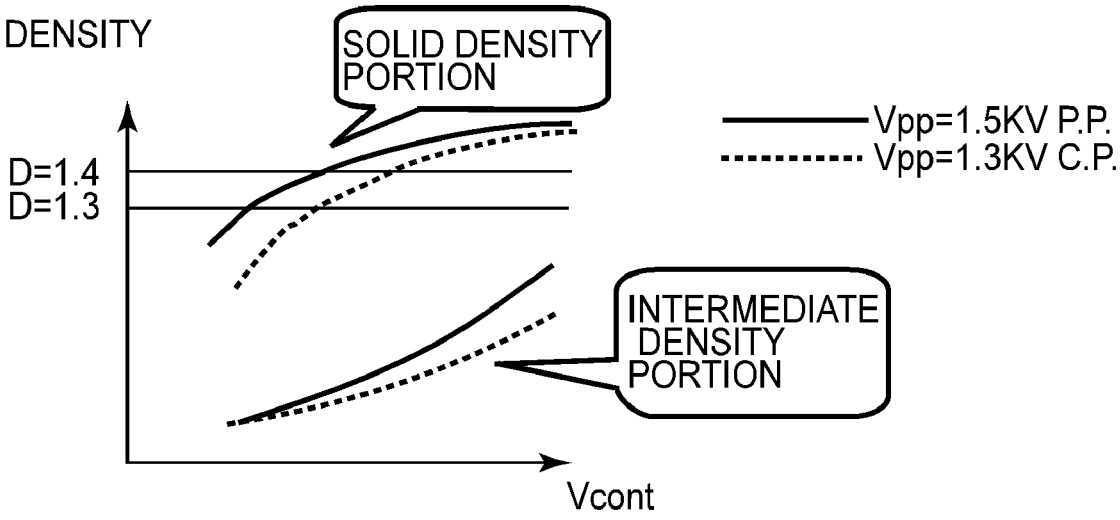
FIG. 9 is a graph showing a relationship between a developing contrast and the density.

FIG. 9 shows a state in which the density at a solid portion (where a target image density is at a maximum level) obtained under the image forming apparatus for each of the plain paper and the coated paper and the density at a halftone portion (where the target image density is at an intermediate level) are changed with the developing contrast (the potential difference between the non-exposed portion potential of the photosensitive member and the developing DC voltage).

In the case of the plain paper, the developing bias to be applied to the developing device, specifically an AC component (AC voltage) of the develop high voltage is Vpp=1.5 kV.

On the other hand, in the case of the coated paper, the AC component (AC voltage) of the developing high voltage is Vpp=1.3 kV. In the case where the Vpp values of the developing bias AC voltages are different, changes in density with developing contrast at the solid portion and at the halftone (intermediate density) portion show different tendencies.

Therefore, it is understood that adjustment with high accuracy cannot be performed even when the image forming condition is corrected on the basis of a result of measurement such that a density change at the solid portion or the halftone portion of one of the plain paper or coated paper is measured during continuous image formation or the like by forming a test image under an image forming condition for one type of the recording paper.

For that reason, a slope of the density change with the developing contrast is different between those for the plain paper and the coated paper, so that it is understood that the image forming condition for one type of the recording paper cannot be corrected by being estimated from the density change for anther type of the recording paper.

Figure 10:
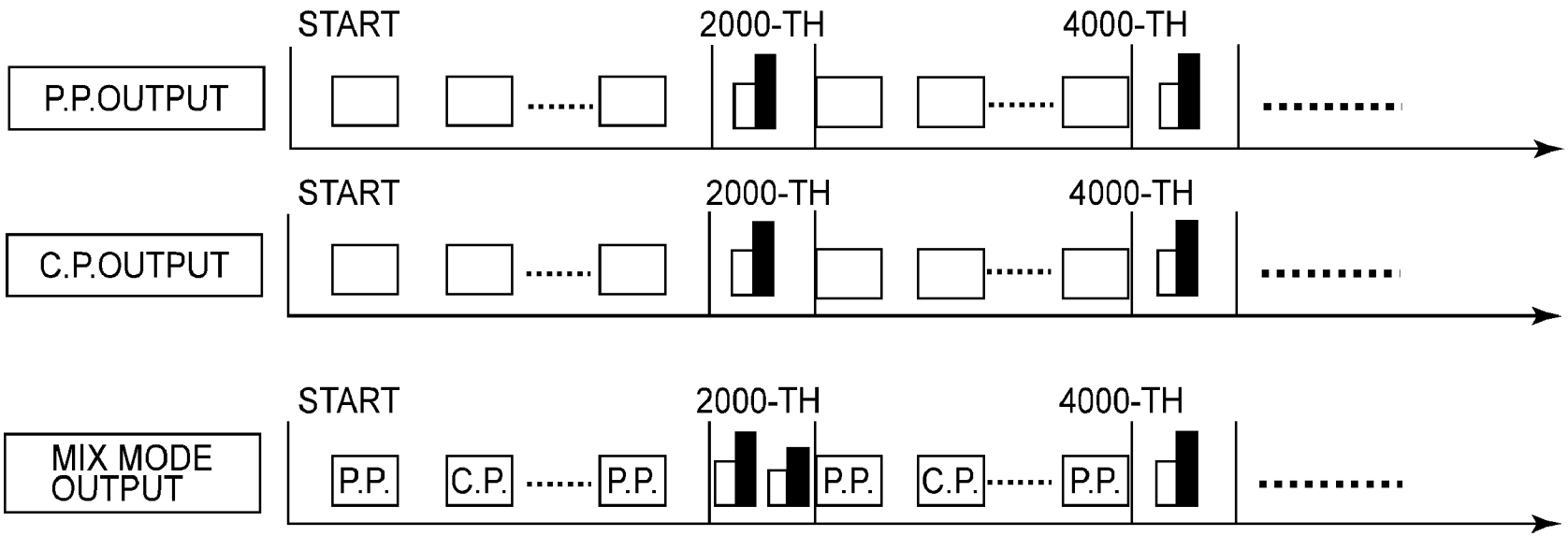
FIG. 10 is a schematic view showing a model of continuous image formation.

As shown in FIG. 10, the test image is formed at a predetermined interval under an image forming condition for output recording paper during continuous image formation of single recording paper such as the plain paper or the coated paper. On the basis of a result of measurement of the density of the test image, control for correcting the developing condition based on the relation information shown in FIG. 9 stored in the storing portion of the engine controller 50 is made.

In the case where the presence of a print history with respect to a plurality of type of the recording paper in a period in which the test pattern is formed on the predetermined number of output sheets is detected, as shown in FIG. 10, a control means for forming the test image under a plurality of image forming conditions is employed.

By using such a control means, a difference in density fluctuation varying every image forming condition for each recording paper is detected and the plurality of image forming conditions are adjusted, so that the density and image quality in the continuous image formation in the mixed mode are stabilized.

The above-described image forming mode and the image forming condition switching control during the formation of the test pattern will be specifically described with reference to a flow chart shown in FIG. 11.

Figure 11:
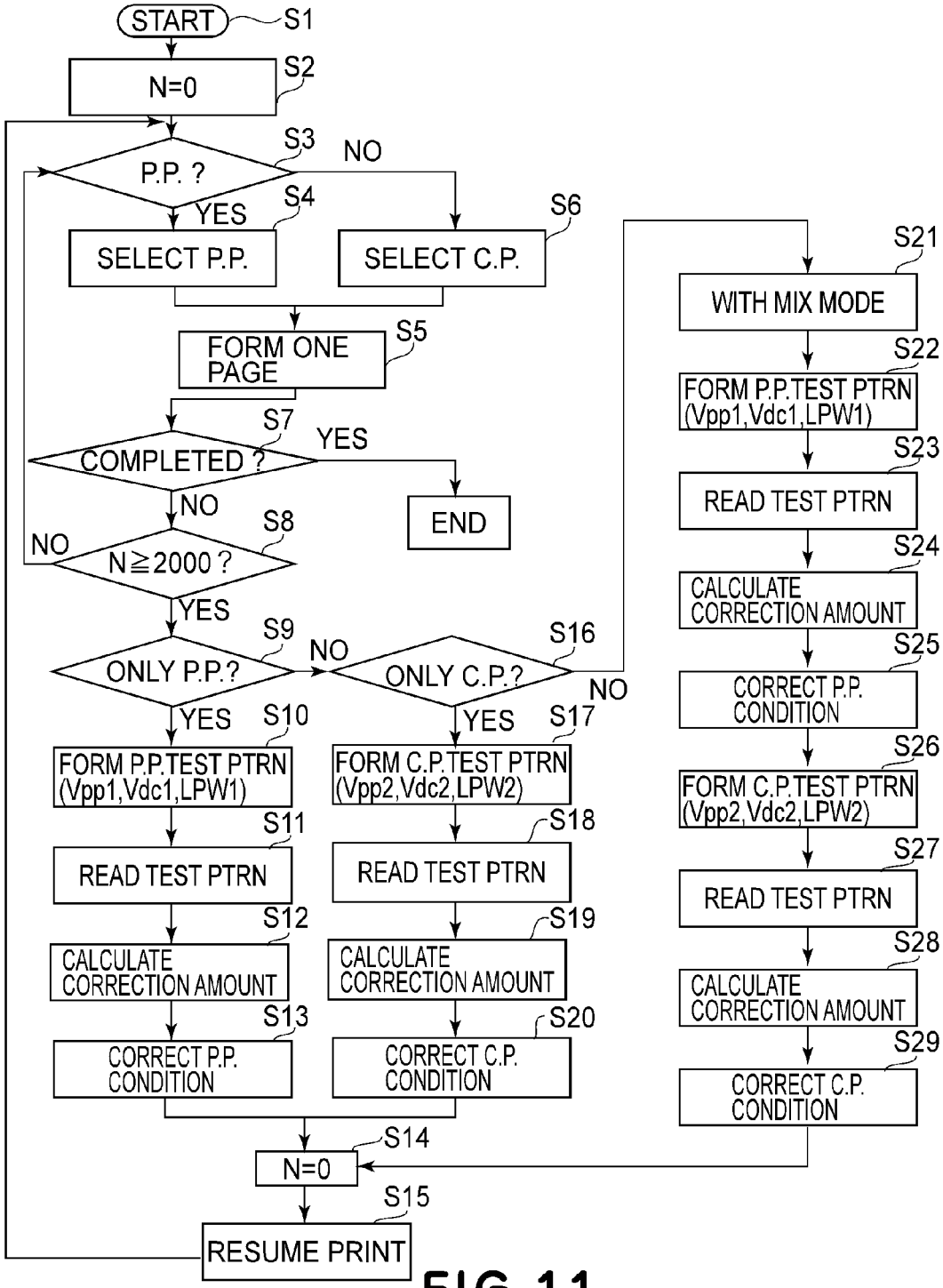
FIG. 11 is a flow chart for illustrating Embodiment 1.

In FIG. 11, first, printing is started (step S1), immediately before printing on a first image (step S2), the type of the recording paper is discriminated (step S3). As a result, an image forming condition for the plain paper or the coated paper is selected depending on the type of the recording paper (steps S4 and S6).

As the image forming condition, three types of values of the exposed portion potential VL, the developing DC high voltage, and Vpp values of the developing AC voltages (a first AC voltage and a second AC voltage) are changed depending on the type of the recording paper by switching the exposure condition. Further, reference symbols for the image forming condition for each recording paper indicated in the flow chart of FIG. 11 are identical to those indicated in FIG. 12.

The switching of the image forming condition is performed page by page (step S5), and the printing is made while switching the image forming condition every type of the recording paper until the number of output sheets reaches 2000 sheets as timing of forming the test pattern (step S7). In the case where the print is continued until 2000 sheets are continuously output, the test pattern is formed with the timing.

For the test pattern formation, on the basis of an output history of 2000 sheets (step S8), reference is made to the output history as to whether the output is a plain paper output (step S9) or a coated paper output (step S16). Further, the reference is also made to the output history as to whether or not the printing is performed in the mixed mode of the plain paper (first sheet) and the coated paper (second sheet). Based on a result of these references, a test pattern forming condition is determined.

By this control, the test pattern is formed on the basis of the output history of the recording paper in an output period of previous 2000 sheets. That is, in the case of only the plain paper output, the test pattern (first test pattern) is formed under the image forming condition for the plain paper (step S10). In the case of only the coated paper output, the test pattern (second test pattern) is formed under the image forming condition for the coated paper (step S17). In the case of the mixed mode output of the plain paper and the coated paper, the test pattern is formed under the two image forming conditions for the plain paper and the coated paper. The test pattern formation is performed in manners shown in FIG. 10.

Thereafter, on the basis of a result of detection of the density of the test pattern (steps S11 and S18), a correction amount of the developing contrast is calculated (steps S12 and S19), so that a developing contrast condition for each recording paper is changed. Thus, the correction of the image forming condition is carried out (steps S13 and S20). Thereafter, a counter is reset (step S14) and the printing is resumed (step S15).

In the step S21, where there is the output history in the mixed mode, the test pattern is formed under the image forming condition for the plain paper (step S22). Based on a result of density detection of the test pattern (step S23), an amount of correction of the developing contrast is calculated (step S24) and the developing contrast condition for each recording paper is changed. Thus, correction of the image forming condition is carried out (step S25).

Test pattern is formed under the image forming condition for the coated paper (step S26). Based on a result of density detection of the test pattern (step S27), an amount of correction of the developing contrast is calculated (step S28) and the developing contrast condition for each recording paper is changed. Thus, correction of the image forming condition is carried out (step S29). Thereafter, the counter is reset (step S14) and the printing is resumed (step S15).

As described above, the image forming condition correction for the test pattern performed every the predetermined number of output sheets is carried out in a switching manner with respect to the plain paper (mode), the coated paper (mode), and the mixed mode, the image formation can be effected in a stable condition not only under the output condition for single recording paper but also in the mixed mode.

Incidentally, with each timing at which the image formation of the test pattern is effected, respective operations for mounting and demounting the back-up roller 7 are performed for about 250 ms. Each of ON and OFF operations of secondary transfer high voltage application (not shown) requires 100 ms.

Thus, the image formation and density detecting operation of the test pattern need not only a time required for the image formation but also times required for the contact and separation operation of the secondary transfer roller and for a stopping operation of the recording paper in a feeding path from the cassette and in a conveying path.

Particularly, in order to effect the test pattern image formation and the density measurement control while temporarily stopping a sheet interval time, stop processing operations before and after the image formation and the density measurement control are also required, so that frequent addition of adjusting operations becomes a factor of causing a lowering in productivity.

The productivity is required to be ensured in consideration of such a test pattern forming time, the print stopping operations before and after the image formation, and the resuming operation. For example, when the test pattern formation is effected at irregular intervals for each change in the type of recording paper on the basis of the print information during the continuous image formation, operations of devices performed before and after the test pattern formation are also requires, so that the number of unnecessary operations is increased.

In this embodiment, the test pattern formation is periodically effected every 2000 sheets to reduce the frequency of the test pattern formation, so that a time required for the stop of the device and resuming processing before and after the test pattern formation is minimized.

As in the image forming apparatus of this embodiment, by taking into consideration a necessary test pattern forming pattern correspondingly to the type of output table recording paper, the productivity in the mixed mode is ensured.

Figures 12, 13:
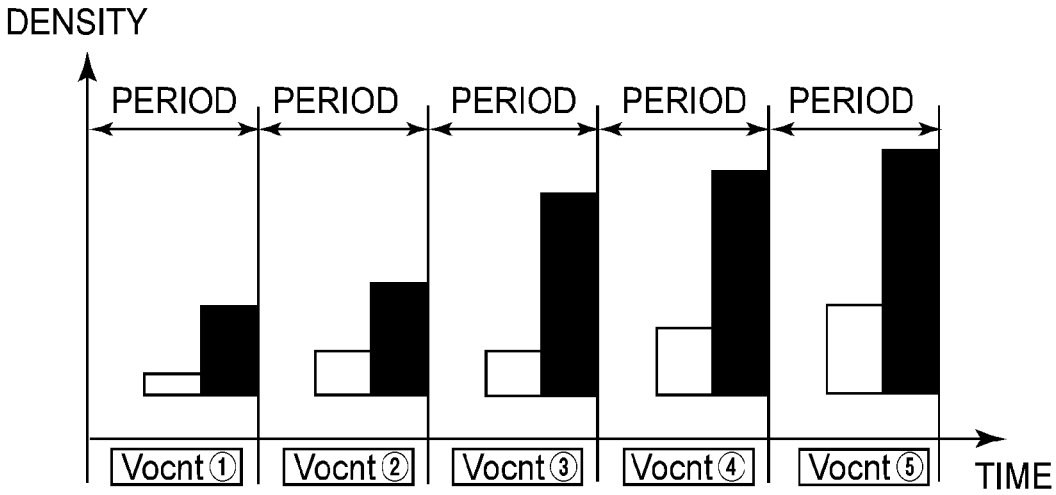
FIG. 12 is an explanatory view of an image forming condition.
FIG. 13 is a schematic view showing a model for obtaining a relationship between the developing contrast and the density at an intermediary portion or at a solid portion.

In this embodiment, as shown in FIG. 13, on the basis of the measurement result of the test image density, the relationship between the developing contrast and the density as shown in FIG. 9 is stored in the engine controller 50 and then the correction amount of the developing contrast is calculated timely correspondingly to the density change. Incidentally, the test image density refers to a solid portion density and an intermediate density (halftone portion density) which vary depending on each type of the recording paper and are obtained in the case where the developing contrast potential is changed.

In this embodiment, the adjustment of the developing condition is performed by adjusting the develop DC voltage and the exposure amount, so that the correction control is carried out so as to obtain a density determined for each type of the recording paper.

Figure 14:
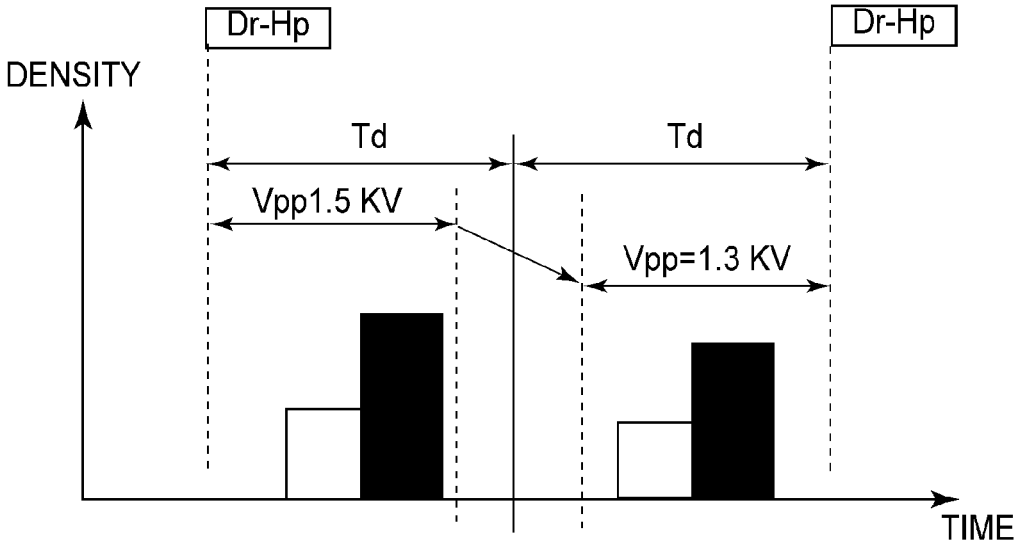
FIG. 14 is a schematic view showing a test image pattern in a mixed (image forming) mode.
Figure 15:
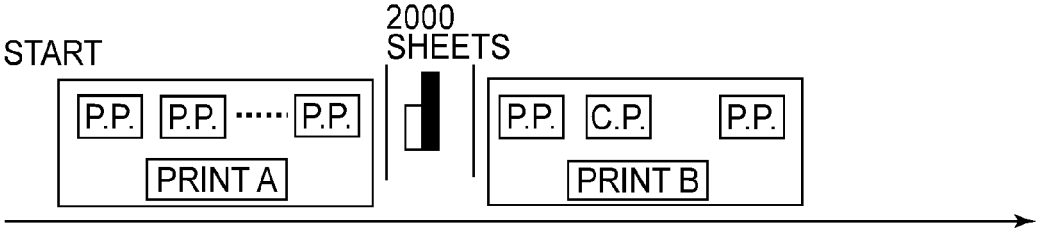
FIG. 15 is a schematic view showing a model in the case where a printed matter of single recording paper and a printed matter of a mixture of two types of recording paper are formed.

With respect to the test pattern formation effected under the plurality of image forming conditions in the mixed mode, as shown in FIG. 14, the develop AC voltage set for each type of the recording paper is variably controlled and the test image is formed under the image forming condition set for each type of the recording paper.

During printing such that a plurality of types of the recording paper is subjected to alternately continuous image formation, in the case of forming the test images under a plurality of different image forming conditions, the order of the image forming condition can affect and reduce a time required for control at the time of transition to the test image formation. Therefore, it is desirable that the test image is formed from under the image forming condition for the recording paper immediately before the test image formation.

Thus, in this embodiment, such a control means that the image forming condition at the time of forming the test image at the predetermined interval on the basis of the history of the recording paper subjected to the printing during the continuous image formation is timely determined depending on the type of the recording paper is provided. As a result, even in the case of employing a different image forming condition for each type of the recording paper, it is possible to effect stable image formation.

Embodiment 1 is described above specifically but the present invention is not limited to Embodiment 1. The embodiment may also be appropriately modified within the scope of the present invention.

Embodiment 2

In Embodiment 1, in the output state in the predetermined period in which the test image is formed, the image forming condition for forming the test image is selected with the predetermined interval on the basis of the information on the type of the recording paper stored in the storing portion of the engine controller 50.

For that reason, the test pattern forming condition is determined only based on the print information in the predetermined period, so that the test image formation is influenced by the recording paper information for the printed matter. Therefore, in the case where the coated paper test image is formed immediately after the plain paper test image formation, the density on the coated paper can be deviated from a target value.

For example, there is the case where a printed matter A is printed on the plain paper in a period until 2000 sheets of the test image are formed and subsequently a printed matter B is continuously printed in the mixed mode.

In this embodiment, even in such a case, with respect to the image forming condition for each type of the recording paper, a plurality of image forming conditions is stabilized before the two types of the recording paper are used, so that it is possible to effect further stabilized image formation.

In the present invention, in the case where it is known in advance that the mixed mode is to be continuously executed on the basis of the type information on the recording paper contained in the print information sent from the PC 30 shown in FIG. 3 even when there is no output history of the plurality of types of the recording paper at the time when the number of output sheets reaches 2000 sheets, the control for the mixed mode is effected first.

Figure 16:
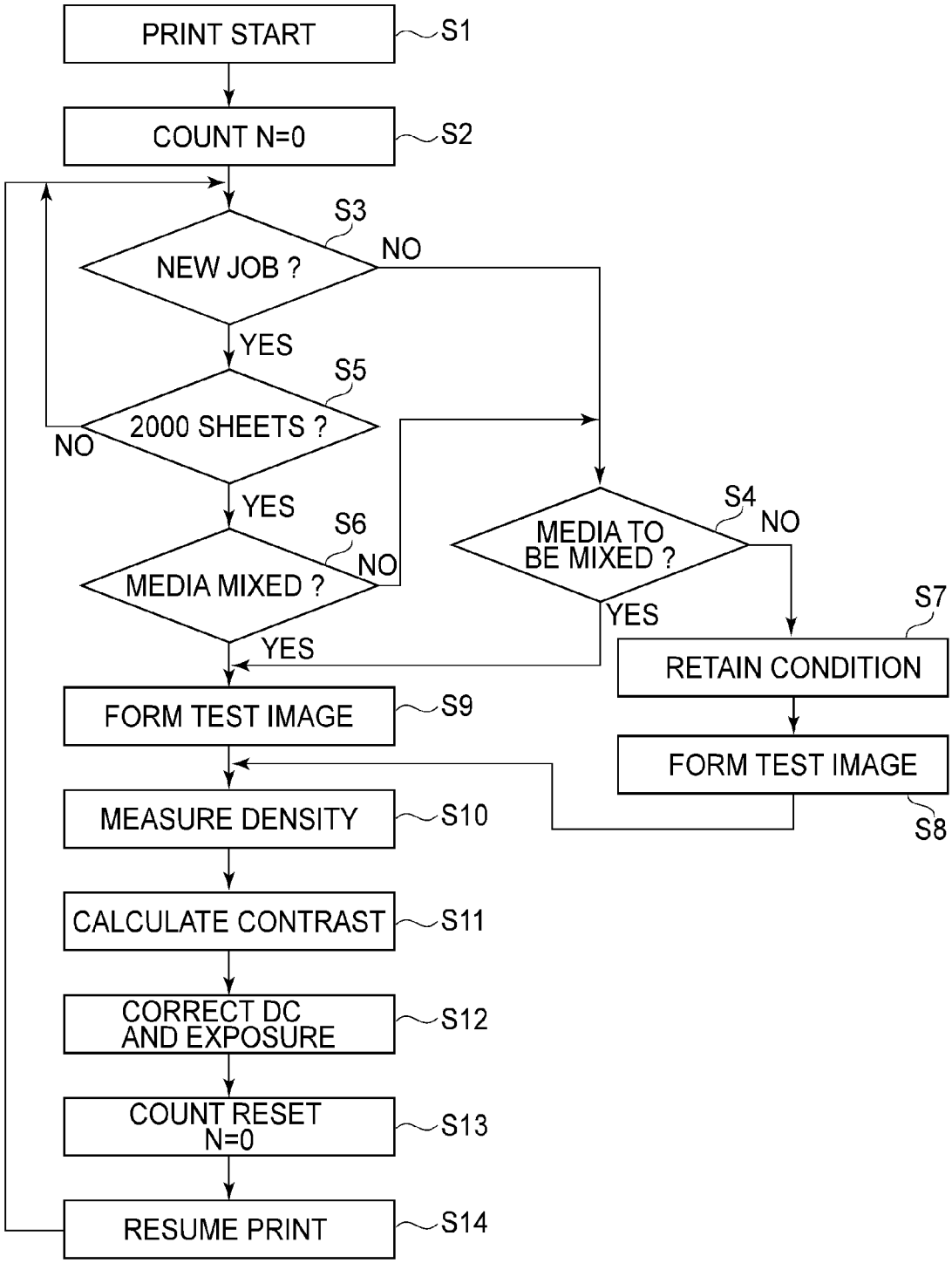
FIG. 16 is a flow chart for illustrating Embodiment 2.

Hereinbelow, this embodiment will be described with reference to FIG. 16 showing a flow chart. The contents of the flow chart are similar to those described in Embodiment 1, so that only a different portion will be described.

First, in accordance with a print instruction from the PC 30, image formation is started (steps S1 and S2). Thereafter, during continuous output, confirmation as to whether or not the image forming controller 40 receives print information with the mixed mode from the PC 30 as a subsequent print instruction is made (step S3). By adding this step S3, it is possible to judge whether or not there is a schedule of the mixing mode in the print information received after the start of the image formation.

Thereafter, output of 2000 sheets is effected (step S5), and in step S6, in the case where there is no mixed mode history in an output period until that time, confirmation as to whether or not there is a schedule of the mixed mode is made (step S4).

In the step S4, in the case where the mixed mode is scheduled, as shown in FIG. 14, the test images are formed under a plurality of image forming conditions for the type of the recording paper (step S9). Then, by detecting the density change (step S10), the density fluctuation for not only the image forming condition for the output plurality of but also the image forming condition for another recording paper can be corrected in advance (steps S11 and S12). Therefore, even when subsequently scheduled printing of the printed matter in the mixed mode is effected, it is possible to effect stable image formation. Thereafter, the counter is reset (step S13) and the printing is resumed (step S14). In the case where the mixed mode is not scheduled, the image forming condition of the output history is retained (step S7) and the test image is formed (step S8).

As described above, by utilizing the recording paper information contained in the print information from the PC 30 in advance, it is possible to always stabilize the image forming condition in the mixed mode.

Embodiment 3

In Embodiment 2, when the test images are formed on 2000 sheets on the basis of the recording paper information of the print information received from the PC 30, the test pattern images are formed under the image forming conditions depending on the type of the recording paper as shown in FIG. 14.

In this embodiment, a ratio of the number of output sheets for each type of the recording paper is also taken into consideration by making judgment and control of not only the type of the recording paper contained in the print information but also print number information. Further, the image forming condition for the recording paper with a larger output ratio is stabilized preferentially and with respect to the recording paper with a less number of output sheets, the number of test patterns is decreased to realize reduction in toner consumption amount and improvement in productivity.

Further, in this embodiment, a constitution in which a productivity priority mode and an image quality stabilization priority mode are selectable at an operating portion of the image forming apparatus or on a printer driver screen of the PC 30 which provides the print instruction is employed. Further, the image forming apparatus is operated only in the case where the productivity priority mode is selected. The control flow is roughly similar to that shown in FIG. 16, so that a portion thereof associated with this embodiment is shown in FIG. 17.

In this embodiment, in the case where the schedule of the mixed mode is confirmed, the number of test patterns with respect to the recording paper having a less output ratio in the mixed mode is reduced by calculating the output sheet ratio for each type of the recording paper on the basis of the print information.

Figure 17:
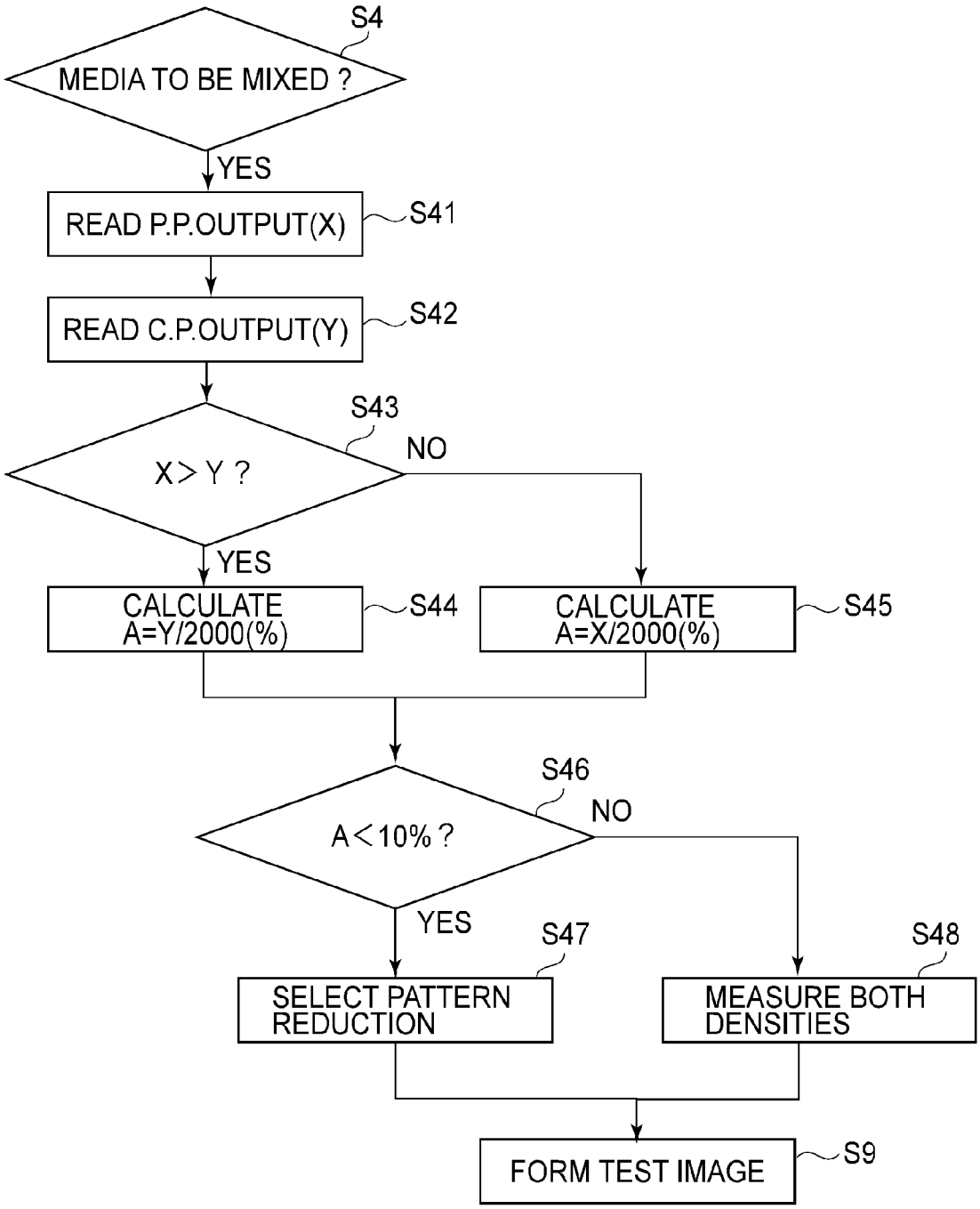
FIG. 17 is a flow chart for illustrating Embodiment 3.

In the step S4 of FIG. 17, in the case where the schedule of the mixed mode is confirmed, the ratio of the output sheets for each type of the recording paper is calculated (steps S41 to S45). In a step S46, in the case where the ratio of the less number of output sheets is less than 10%, the test pattern for each 2000 sheets to be formed in the step S9 of FIG. 16 is switched.

That is, FIG. 18 shows a test pattern in the case where the mixed mode of the plain paper and the coated paper is scheduled and the output ratio of the coated paper is less than 10%. By decreasing the number of the test patterns for the recording paper with the less output ratio (step S47), it is possible to shorten the time required for the test image formation and to reduce the toner consumption amount.

Further, with respect to the test pattern formed under the image forming condition for the recording paper with the more output ratio, both of a high density and the intermediate density are measured, so that the density correction is made with high accuracy (step S48). Further, with respect to the recording paper with the less output ratio, the density change of the test pattern with the intermediate density is measured and by using a relationship between the intermediate density and the developing contrast shown in FIG. 19, the image forming condition is corrected and stabilized.

The setting value of the output ratio below which the number of the test patterns is reduced is not limited to 10% but may also be appropriately changed depending on the constitution and stability of the engine.

Embodiment 4

In Embodiment 4, the productivity priority mode in Embodiment 3 is selected. The test image pattern is controlled every type of the recording paper with the less number of output sheets on the basis of the density measurement results of the intermediate density as shown in FIG. 18. Even in this case, when the density fluctuation of the recording paper with the less output ratio is judged to be large, a control means capable of switching the control to control for forming the test patterns with both of the high density and the intermediate density shown in FIG. 14 is provided. Further, even in the priority mode, in the case where the density fluctuation not less than a predetermined density value is detected, a large density fluctuation is not caused to occur by switching the productivity priority mode to the image quality stabilization priority mode.

In Embodiment 3, the control such that with respect to the test image for the recording paper with the less number of output sheets, only the intermediate density is measured and with respect to the image forming condition for the recording paper with the more number of output sheets, the density fluctuations at both of the high density portion and the intermediate density portion are measured, is effected.

The control constitution in Embodiment 3 shows the substantially same characteristic with respect to the solid portion density even when the Vpp value of the developing high voltage is different as shown in FIG. 19, thus being an effective means in the case where the intermediate density characteristic varies.

However, in such a situation that due to an increase in the number of continuous output sheets and an environmental fluctuation with respect to the developing device 3, the density changes at the solid portion and the intermediate density portion cause large differences as shown in FIG. 9, accuracy of the density control can be lowered.

In this embodiment, at the time of actuating the image forming apparatus, an intermediate density value for each image forming condition under a condition in which a developing contrast is set correspondingly to an image forming condition for each type of the recording paper is stored as an initial value. Further, a density difference in intermediate density between respective image forming conditions is stored in the storing portion of the engine controller 50 as a difference in intermediate density between the plain paper and the coated paper.

In the image forming apparatus of this embodiment, in adjusting control of the respective image forming conditions performed at the time of actuating the engine, data as shown in FIG. 20 is stored in the storing portion of the engine controller 50. That is, for each type of the recording paper, values of the developing contrast (CONTRAST), the solid portion density (S.D.), the intermediate density (I.D.), and the density difference (D.D.) between intermediate densities for the plain paper and the coated paper are stored in the storing portion.

As a result of the intermediate density measurement (step S10) in FIG. 10, with respect to the initial difference in density, a density change not less than a predetermined value is caused to occur. In this case, the test image formation is continued and the relationship between the developing contrast and the density measured at the time of actuating the engine as shown in FIG. 14 is subjected again to the measurement for each type of the recording paper.

Thereafter, the test pattern formation to be effected at a predetermined interval is carried out by control in which the pattern is switched to the pattern shown in FIG. 14 to stop the productivity priority mode to be shifted into the stability priority mode. In this embodiment, in the case where a density difference of 0.1 or more, in terms of the reflection density, with respect to the difference in initial intermediate density is detected by the toner density sensor 10, it is judged that the density fluctuation is large, so that the density control shown in FIG. 13 is carried out.

As described above, even in the productivity priority mode, it is possible to always effect the continuous image formation in the mixed mode by appropriately re-measuring the relationship between the test pattern density and the developing contrast after confirming the density fluctuation of the intermediate density (halftone density) and by automatically switching the productivity priority mode into the stability priority mode.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 238433/2008 filed Sep. 17, 2008, which is hereby incorporated by reference.

What is claimed is:

1. An image forming apparatus comprising:

a photosensitive member;

an image forming station including a charging device for electrically charging said photosensitive member, an exposure device for exposing to light the photosensitive member charged by the charging device, a developing device for developing with toner an electrostatic latent image formed on said photosensitive member by the exposure device, and a bias applying device for applying to the developing device a developing bias comprising a DC voltage and an AC voltage;

a transfer device for transferring a toner image from said photosensitive member onto a sheet;

a setting device for setting the AC voltage at a first AC voltage when image formation is effected on a first sheet and setting the AC voltage at a second AC voltage different from the first AC voltage when image formation is effected on a second sheet different in type from the first sheet;

an executing device for executing a test mode for forming a test image on said photosensitive member;

a density detecting device for detecting a density of the test image in the test mode; and an adjusting device for adjusting an image forming condition for said image forming station depending on an output of said density detecting device;

wherein when said executing device executes the test mode during a job for effecting image formation successively on a plurality of sheets including the first sheet and the second sheet, a first test image is formed with the AC voltage set at the first AC voltage and then a second test image is formed with the AC voltage set at the second AC voltage.

2. The image forming apparatus according to claim 1, wherein the first AC voltage and the second AC voltage are different in peak-to-peak voltage.

3. The image forming apparatus according to claim 1, wherein an image forming speed of the first sheet and an image forming speed of the second sheet are substantially equal to each other during the job.

4. The image forming apparatus according to claim 3, wherein the first sheet is plain paper and the second sheet is coated paper.

5. The image forming apparatus according to claim 3, wherein when the image formation on the first sheet is effected immediately before the execution of the test mode, the executing device executes the test mode during the job so that the first test image is formed first while keeping setting of the AC voltage at the first AC voltage and then the second test image is formed by changing the AC voltage to the second AC voltage.

6. The image forming apparatus according to claim 3, wherein when the image formation on the second sheet is effected immediately before the execution of the test mode, the executing device executes the test mode during the job so that the second test image is formed first while keeping setting of the AC voltage at the second AC voltage and then the first test image is formed by changing the AC voltage to the first AC voltage.

7. The image forming apparatus according to claim 3, wherein when the executing device executes the test mode during a job for effecting image formation successively on only a plurality of first sheets, the first test image is formed without forming the second test image, and wherein when the executing device executes the test mode during a job for effecting image forming successively on only a plurality of second sheets, the second test image is formed without forming the first test image.

8. The image forming apparatus according to claim 1, wherein the transfer device includes an intermediary transfer member onto which the toner image is primary-transferred from said photosensitive member and from which the primary transferred toner image is secondary-transferred onto the sheet, and wherein said density detecting device is provided so as to detect the toner image transferred onto the intermediary transfer member.

9. An image forming apparatus comprising:

a photosensitive member;

an image forming station including a charging device for electrically charging said photosensitive member, an exposure device for exposing to light the photosensitive member charged by the charging device, a developing device for developing with toner an electrostatic latent image formed on said photosensitive member by the exposure device, and a bias applying device for applying to the developing device a developing bias comprising a DC voltage and an AC voltage;

a transfer device for transferring a toner image from said photosensitive member onto a sheet;

a setting device for setting the AC voltage at a first AC voltage when image formation is effected on a first sheet and setting the AC voltage at a second AC voltage different from the first AC voltage when image formation is effected on a second sheet different in type from the first sheet;

an executing device for executing a test mode for forming a test image on said photosensitive member;

a density detecting device for detecting a density of the test image in the test mode; and an adjusting device for adjusting an image forming condition for said image forming station depending on an output of said density detecting device;

wherein when said executing device executes the test mode during a job for effecting image formation successively on a plurality of sheets including the first sheet and the second sheet, a first test image is formed with the AC voltage set at a third AC voltage correlated with the first AC voltage and then a second test image is formed with the AC voltage set at the second AC voltage.

10. The image forming apparatus according to claim 9, wherein the first AC voltage and the second AC voltage are different in peak-to-peak voltage.

11. The image forming apparatus according to claim 9, wherein an image forming speed of the first sheet and an image forming speed of the second sheet are substantially equal to each other during the job.

12. The image forming apparatus according to claim 11, wherein the first sheet is plain paper and the second sheet is coated paper.

13. The image forming apparatus according to claim 11, wherein when the image formation on the first sheet is effected immediately before the execution of the test mode, the executing device executes the test mode during the job so that the first test image is formed first while keeping setting of the AC voltage at the first AC voltage and then the second test image is formed by changing the AC voltage to the second AC voltage.

14. The image forming apparatus according to claim 11, wherein when the image formation on the second sheet is effected immediately before the execution of the test mode, the executing device executes the test mode during the job so that the second test image is formed first while keeping setting of the AC voltage at the second AC voltage and then the first test image is formed by changing the AC voltage to the first AC voltage.

15. The image forming apparatus according to claim 11, wherein when the executing device executes the test mode during a job for effecting image formation successively on only a plurality of first sheets, the first test image is formed without forming the second test image, and wherein when the executing device executes the test mode during a job for effecting image forming successively on only a plurality of second sheets, the second test image is formed without forming the first test image.

16. The image forming apparatus according to claim 9, wherein the transfer device includes an intermediary transfer member onto which the toner image is primary-transferred from said photosensitive member and from which the primary transferred toner image is secondary-transferred onto the sheet, and wherein said density detecting device is provided so as to detect the toner image transferred onto the intermediary transfer member.

* * * * *